US007134406B1

(12) United States Patent
Loes

(10) Patent No.: US 7,134,406 B1
(45) Date of Patent: Nov. 14, 2006

(54) COOLING FAN CONTROL FOR IMPROVED ENGINE LOAD ACCEPTANCE

(75) Inventor: Todd Alan Loes, Waterloo, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 11/221,601

(22) Filed: Sep. 8, 2005

(51) Int. Cl.
*F01P 7/02* (2006.01)

(52) U.S. Cl. ..... 123/41.11; 123/41.49

(58) Field of Classification Search ..... 123/41.11, 123/41.12, 41.48, 41.49
See application file for complete search history.

(56) References Cited

U.S. PATENT DOCUMENTS 4,522,553 A 6/1985 Nelson et al.
6,199,006 B1 3/2001 Weiss et al.
6,589,136 B1 7/2003 Ephraim et al.
6,655,351 B1 12/2003 Sheidler et al.
6,745,727 B1 6/2004 Kramer et al.
6,772,714 B1 8/2004 Laird et al.

*Primary Examiner*—Noah P. Kamen

(57) ABSTRACT

The present invention provides a means for momentarily reducing cooling fan load on an engine when a machine encounters sudden loads. The system includes an engine, a load driven by the engine, a cooling system associated with the machine, and one or more controllable cooling fans for delivering air to the cooling system. A controller continually monitors engine speed, reducing fan load when engine speed is both decreasing faster than a maximum rate and is lower than the desired speed. The controller then re-engages the fan load when engine speed is approximately equal to the desired speed or when a maximum disengagement time has elapsed.

11 Claims, 3 Drawing Sheets

COOLING FAN CONTROL FOR IMPROVED ENGINE LOAD ACCEPTANCE

FIELD OF THE INVENTION

The present invention relates to control of internal combustion engines, and more specifically, to the control of cooling fans associated with the engine.

BACKGROUND OF THE INVENTION

Many engine powered machines, such as standby power units or ground engaging vehicles, are subject to "block-loads" or "impact loads" where engine load rises very quickly, causing engine speed to drop dramatically until either the load is reduced or enough power is produced by the engine to compensate. In many cases, the engine just dies, to the dissatisfaction of the operator.

SUMMARY OF THE INVENTION

In most engine powered machines, cooling fans draw up to 10% of the available power. The present invention provides a means for improved load acceptance by momentarily reducing cooling fan load on the engine when the machine encounters sudden loads.

DETAILED DESCRIPTION

Figure 1:
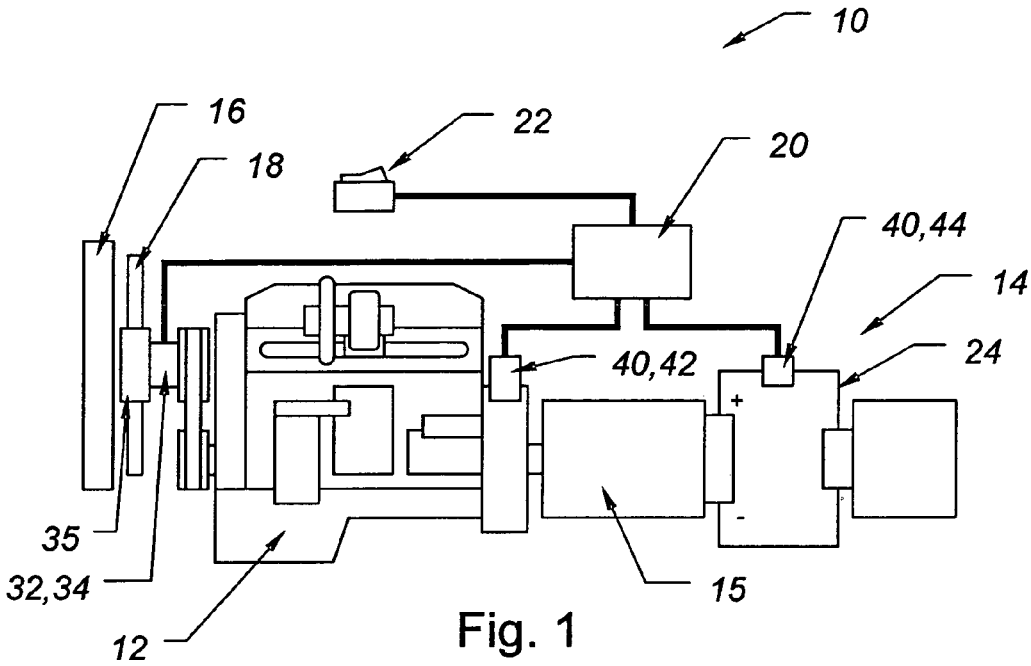
FIG. 1 illustrates a first embodiment for a cooling fan control system.
Figure 2:
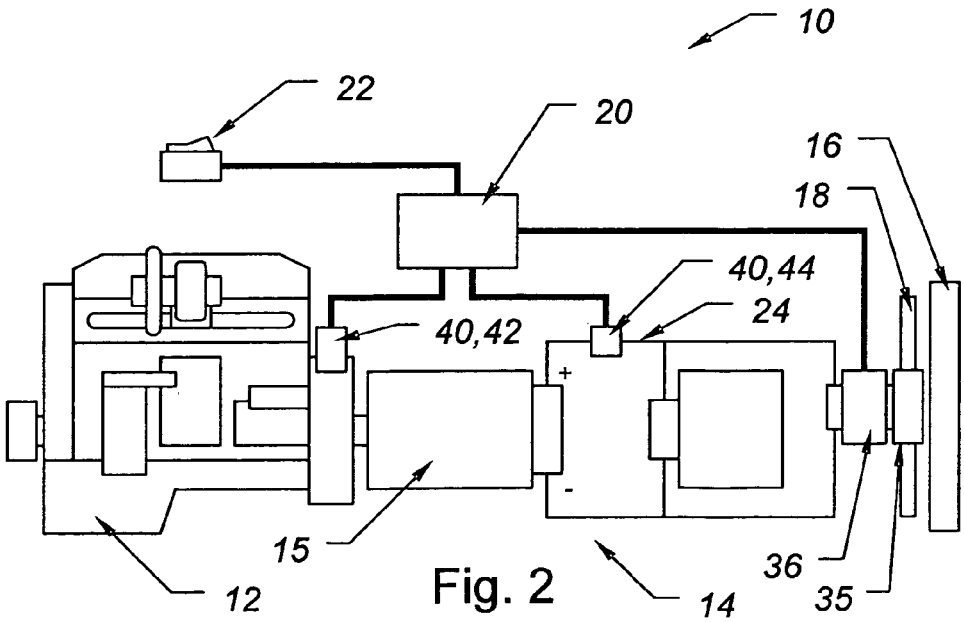
FIG. 2 illustrates a second embodiment for a cooling fan control system.
Figure 3:
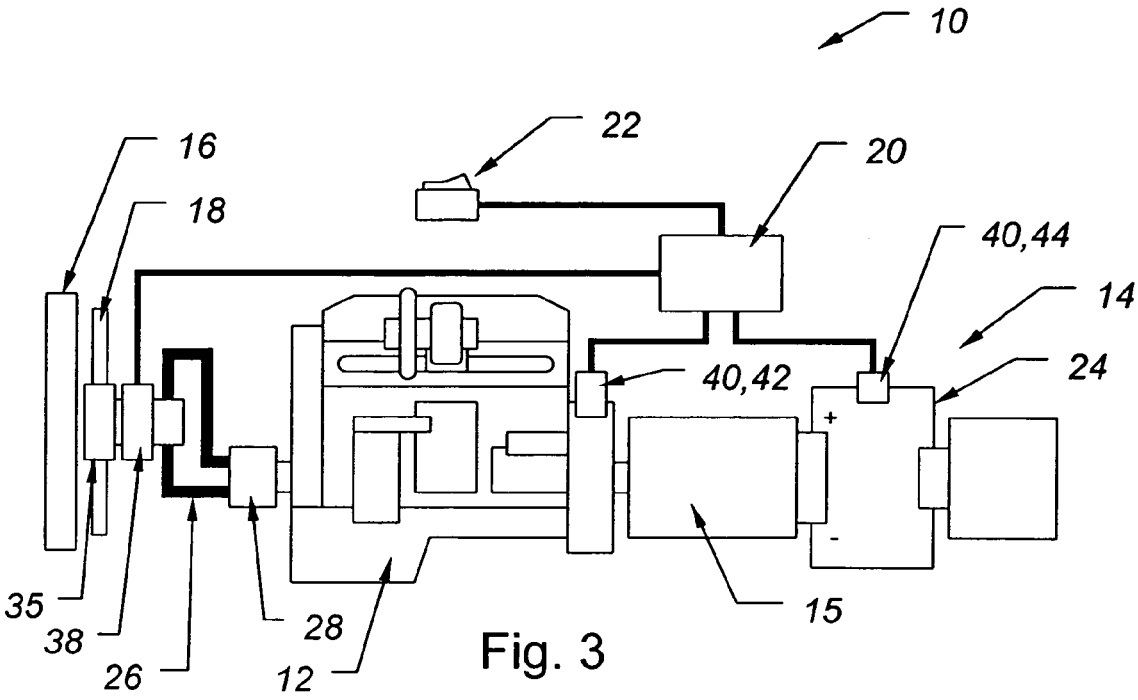
FIG. 3 illustrates a third embodiment for a cooling fan control system.

FIGS. 1–3 illustrate configurations for an engine powered machine 10 such as a mobile vehicle or stationary power unit. Each configuration includes an engine 12, a load 14 driven by the engine 12, a cooling system 16 associated with the machine 10, and one or more controllable cooling fans 18 for delivering air to the cooling system 16. Each configuration also includes an electronic controller 20 adapted to monitor and command the functions of the engine 12 and the cooling fans 18, as well as an operator input 22 for selecting engine 12 function or speed. In the illustrated embodiments, the engine 12 is an electronically controlled internal combustion engine, and the load 14 driven by the engine is an electrical generator.

In a first embodiment illustrated in FIG. 1, the cooling fan 18 is mechanically driven by the engine via a clutch 32 or a variable-speed drive 34. Alternatively, the fan 18 may also be provided with variable pitch fan blades 35. When using a clutch 32, the controller 20 is adapted to disengage the cooling fan 18 to reduce load on the engine 12. When using a variable-speed drive 34, the controller 20 is adapted to reduce cooling fan 18 speed, thus reducing load on the engine 12. When using variable pitch fan blades 35, the controller 20 is adapted to reduce fan blade 35 pitch to reduce load on the engine 12.

In a second embodiment illustrated in FIG. 2, the cooling fan 18 is driven by an electric motor 36 that is powered from current 24 developed by the electrical generator 15 driven by the engine 12. In this embodiment, the controller 20 is adapted to slow or disengage the motor 36 to reduce load on the generator 15. In a third embodiment illustrated in FIG. 3, the cooling fan 18 is powered by a hydraulic motor 38 driven from pressure 26 developed by a pump 28 driven by the engine 12. In this embodiment, the controller 20 is adapted to slow or disengage the hydraulic motor 38 to reduce load on the hydraulic pump 28. In both of the preceding embodiments, reducing the cooling fan 18 load has the effect of reducing load on the engine 12.

In the present invention, a sensor 40 is employed to indicate engine speed. In the illustrated embodiments, engine speed is sensed with a position encoder 42, or alternatively, via a current frequency sensor 44. Position encoders 42 are commonly used with electronically controlled engine 12 as a means of measuring engine speed directly from an output shaft, or from a driven member or accessory. When the engine 12 is used to drive an electrical generator 15, frequency measurements from a sensor 44 monitoring current 24 from the generator 15 may also be used as a proxy for engine speed.

Figure 4:
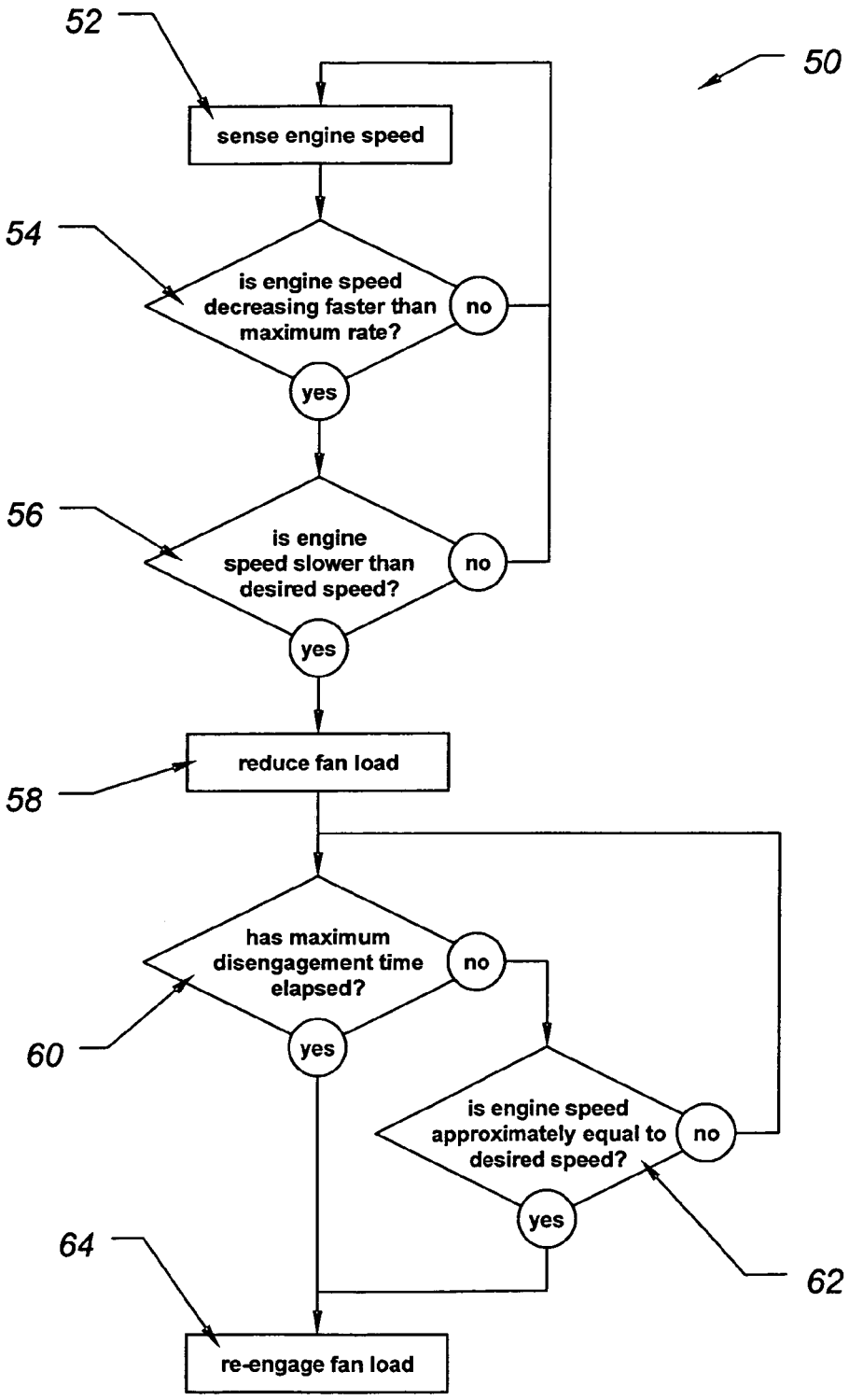
FIG. 4 illustrates a method of operating the cooling fan control system.

During steady-state engine operation, the controller 20 continually monitors engine speed 52 and adjusts fueling and/or other parameters in an effort to maintain a desired engine speed. The desired engine speed may be determined by an operator input 22, or may be determined automatically by the controller 20 based on other inputs or parameters. In the above described embodiments, the controller 20 is further adapted to reduce fan load 58 to better maintain the desired engine speed when sudden loads are encountered. FIG. 4 illustrates one embodiment for such a control algorithm 50 where the controller 20 reduces fan load 58, either by slowing or disengaging fan 18, or by reducing fan blade 35 pitch, when engine speed is both decreasing faster than a maximum rate 54 and is lower than the desired speed 56. The controller 20 then re-engages the fan load 64 when engine speed is approximately equal to the desired speed 62 or when a maximum disengagement time has elapsed 60. In this example, both the maximum rate of engine speed reduction and the maximum disengagement time are predetermined for the algorithm, but they may also be set by the operator.

Having described the preferred embodiment, it will become apparent that various modifications can be made without departing from the scope of the invention as defined in the accompanying claims.

The invention claimed is:

1. A cooling fan control system for a cooling system associated with a machine driven by an engine comprising:

An engine;

A controllable fan drive;

A sensor indicating engine speed; and

A controller communicating with the fan drive and the sensor, the controller adapted to reduce fan load when engine speed is decreasing faster than a maximum rate and engine speed is lower than a desired speed, the controller further adapted to re-engage fan load when engine speed is approximately equal to the desired speed or when a maximum disengagement time has elapsed.

2. The cooling fan control system described in claim 1 wherein the desired speed is determined automatically or by an operator command.

3. The cooling fan control system described in claim 1 or 2 wherein the sensor is an encoder directly measuring engine speed or a sensor measuring frequency of electrical current developed by a generator driven by the engine.

4. The cooling fan control system described in claim 3 wherein the fan drive is driven mechanically by the engine, driven electrically from current developed by an electrical generator driven by the engine, or driven hydraulically from pressure developed by a pump driven by the engine.

5. A cooling fan control system for a cooling system associated with an electrical generator driven by an engine comprising:

An engine;

A controllable fan drive;

A sensor indicating engine speed; and

A controller communicating with the fan drive and the sensor, the controller adapted to reduce fan load when engine speed is decreasing faster than a maximum rate and engine speed is lower than a desired speed, the controller further adapted to re-engage fan load when engine speed is approximately equal to the desired speed or when a maximum disengagement time has elapsed.

6. The cooling fan control system described in claim 5 wherein the desired speed is determined automatically or by an operator command.

7. The cooling fan control system described in claim 5 or 6 wherein the sensor is an encoder directly measuring engine speed or a sensor measuring frequency of electrical current developed by a generator driven by the engine.

8. The cooling fan control system described in claim 7 wherein the fan drive is driven mechanically by the engine, driven electrically from current developed by the electrical generator driven by the engine, or driven hydraulically from pressure developed by a pump driven by the engine.

9. A method for controlling a cooling fan of a cooling system associated with a machine load driven by an engine comprising the steps of:

Sensing engine speed;

Reducing fan load when engine speed is decreasing faster than a maximum rate and engine speed is lower than a desired speed; and Re-engaging fan load when engine speed is approximately equal to the desired speed or when a maximum disengagement time has elapsed.

10. The method for controlling a cooling fan described in claim 9 wherein the desired speed is determined automatically or by an operator command.

11. The method for controlling a cooling fan in claim 9 or 10 wherein the machine load is an electrical generator.

* * * * *